US005356221A

United States Patent [19]

Achelpohl et al.

[11] Patent Number: 5,356,221

[45] Date of Patent: Oct. 18, 1994

[54] CARRYING HANDLE ASSEMBLY FOR BAGS HAVING FLAT BOTTOMS AND A METHOD AND AN APPARATUS FOR PRODUCING THE SAME

[75] Inventors: Fritz Achelpohl, Lienen; Hermann Sandmeier, Bielefeld, both of Fed. Rep. of Germany

[73] Assignee: Windmoeller & Hoelscher, Lengerich, Fed. Rep. of Germany

[21] Appl. No.: 18,519

[22] Filed: Feb. 17, 1993

[30] Foreign Application Priority Data

Feb. 19, 1992 [DE] Fed. Rep. of Germany ..... 4205062

[51] Int. Cl.[5] ..... B65D 33/14

[52] U.S. Cl. ..... 383/21; 383/6; 383/25; 493/226

[58] Field of Search ..... 383/21, 25, 6; 493/226; 53/413

[56] References Cited

U.S. PATENT DOCUMENTS 1,733,219 10/1929 Duvall ..... 383/21

FOREIGN PATENT DOCUMENTS 1152602 2/1964 Fed. Rep. of Germany .
1181035 7/1965 Fed. Rep. of Germany .
2012084 5/1972 Fed. Rep. of Germany .
8115909 5/1981 Fed. Rep. of Germany .
1402654 5/1965 France .

*Primary Examiner*—Stephen P. Garbe
*Attorney, Agent, or Firm*—Jacobson, Price, Holman & Stern

[57] ABSTRACT

A carrying handle assembly for bags having a flat bottom and more particularly for bags having a cross or block bottom, including two strips of material bent into an L-shape cross section in their position of use, of which the one portion of each strip extending generally in a single plane is bonded with the bottom of the bag and the other portion of each strip, which are arranged alongside of each other, are provided with a carrying handle part. In order to prevent the carrying handle part from being torn out from between the portions of the strips of material, even when subjected to a heavy load, the carrying handle part includes a strip bent into the form of a letter U, having two limbs interconnected by a crosspiece, whose limbs are bonded between and to the superposed portions of the strips of material, which are themselves bonded together.

3 Claims, 2 Drawing Sheets

CARRYING HANDLE ASSEMBLY FOR BAGS HAVING FLAT BOTTOMS AND A METHOD AND AN APPARATUS FOR PRODUCING THE SAME

FIELD OF THE INVENTION

The invention relates to a carrying handle assembly for bags having a flat bottom, and more particularly for bags having a cross or block bottom, consisting of two strips of material bent into an L-shape cross section in their position of use, of which one portion of each strip extending generally in a single, flat plane is bonded to the bottom of the bag and the other portion of each strip, which are arranged projecting upwardly from the portions extending in a single plane, are secured to a carrying handle for the bag, and to a method and an apparatus for producing such bags with a carrying handle assembly.

BACKGROUND OF THE INVENTION

A carrying handle has been disclosed in German patent publication 8,115,909 U. The known carrying handle is formed by providing projecting limbs of L-shaped strips of material, placed back to back, with a stamped elongated handle hole through both strips.

In the case of this known carrying handle, the ends of the stamped handle hole are heavily loaded, during carrying, with the result that tears may start at the end parts of the stamped hole and tears may cause the carrying handle being wrenched out of place.

SUMMARY OF THE INVENTION

One object of the present invention is to provide a carrying handle assembly of the type in which there is no danger of the handle being torn out from the bag even in the case of heavy loads.

In accordance with the invention this object is to be attained in the case of a carrying handle of the sort where the handle consists of a strip folded into a U-shape, having two carrying handle limbs connected by a crosspiece, with the carrying handle limbs bonded between portions of material strips, which are arranged alongside each other, with another portion of the material strip being secured on a bottom of a bag.

In the case of a carrying handle assembly in accordance with the invention, the projecting, bonded together portions of the strips of material (whose other portions are bonded to the flat bottom of a bag) consequently constitute holding parts for the limbs of the U-shaped carrying handle with the result that the limbs of the U-shaped carrying handle are loaded by a tensile force and the tensile forces are taken up by the L-shaped material strips in such a manner that it is impossible for any strain concentrations to be formed on the U-shaped carrying handle which would be responsible for tearing of the limbs of the U-shaped carrying handle from between the opposed portions of the L-shaped strips of material.

The strips of material and/or the carrying handle are preferably manufactured of paper.

A method for the production of the carrying handle assembly in accordance with the invention is characterized in that a first section of a web constituting a first strip of material is provided with a layer of adhesive on one side thereof. A second section of web, which is folded about a transverse line and which constitutes a second strip of material, and whose folded over upper end is bonded to the limbs of a carrying handle, is thrust against the layer of adhesive on a portion of the first web section. An exposed lower web section part of the second web section is provided with a layer of adhesive and another portion of the first web section and the lower web section of the second web section having adhesive applied to it are thrust against the surface of the bottom of the bag to secure the carrying handle assembly to the bottom of the bag.

An apparatus for performing the method in accordance with the invention is characterized in accordance with the invention in that a first gripping cylinder provided with grippers grasps the leading end of a first section of web with its grippers, that a cylinder of an adhesive application means, which is adapted to provide the first section of web with a layer of adhesive, is in engagement with the first gripping cylinder, and in that a second gripping cylinder is in engagement with the first gripping cylinder, which second gripping cylinder by means of its grippers receives a second section of web bonded to a U-shaped handle part from a supply device. The second section of web is folded back onto itself so that the part of the second section of web bonded to the handle part is folded over a trailing part of the second section of web. The leading part of the second section of web bonded to the handle part is thrust onto a trailing part of the first section of web which is provided with a layer of adhesive. A second adhesive application means is in engagement with the first gripping cylinder with the second adhesive application means having an adhesive application roll adapted to provide a leading part of the first section of web and the trailing part of the second section of web, folded over the U-shaped handle part, with a layer of adhesive and in that the first gripping cylinder is adapted to then thrust the formed carrying handle assembly against a bottom of a bag.

Methods and apparatus for the production of such a U-shaped handle part are disclosed in the German patent publications 2,012,084 C and 1,152,602 C. The production of the U-like handle and the manner in which the U-shaped handle is applied to a flat web section, does therefore not have to be described in detail. Regarding the manner of production and the application of the U-shaped handle, reference is additionally to be had to the German patent publications 2,018,081 C and 1,181,035 C.

These and other objects of the invention, as well as many of the intended advantages thereof, will become more readily apparent when reference is made to the following description taken in conjunction with the accompanying drawings.

BRIEF DESCRIPTION OF THE DRAWINGS one working embodiment of the invention will now be described in detail with reference to the drawing.

DETAILED DESCRIPTION OF THE PREFERRED EMBODIMENTS

Figure 1:
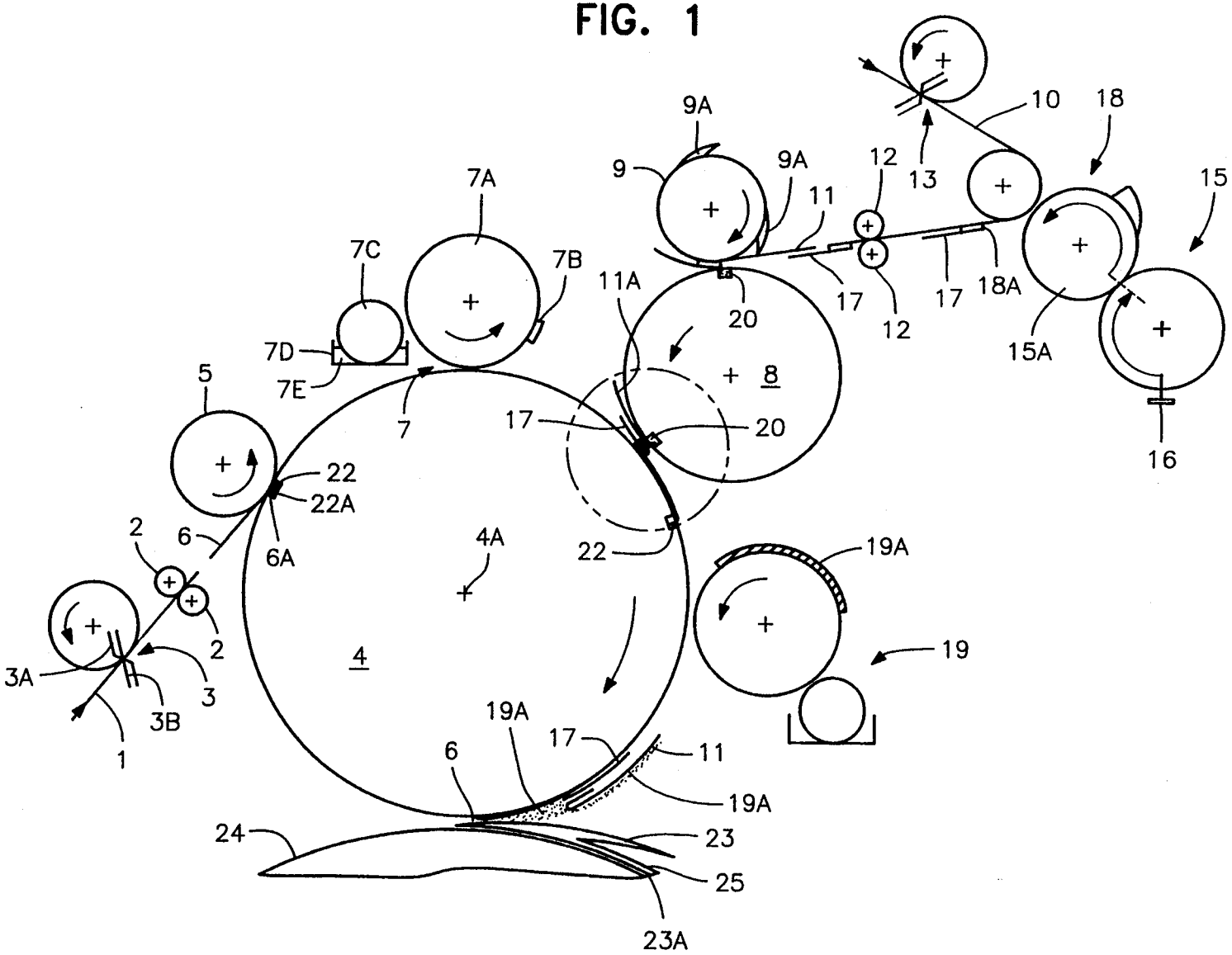
FIG. 1 is a diagrammatic side elevation of an apparatus for the production and application of a carrying handle assembly to a flat bottom of a bag.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 diagrammatically shows a side elevational view of a device for the production and application of a carrying handle assembly to the flat bottom part of a bag, with reference to which the apparatus and the method in accordance with the invention will now be described in detail.

The web 1 of paper entering the apparatus is drawn off from a supply roll, not illustrated. The draw off of the web 1 takes place using a pair of feed rolls 2. The paper web 1 drawn into the apparatus is provided with transverse lines of perforations at predetermined intervals by a rotating perforating knife 3A engaging a fixed knife 3B of the perforating station 3. The perforated paper web 1 is held fast by the pair of feed rolls 2 so that individual paper strips 6 are torn off along the line of perforations by the mating cylinder 5. The mating cylinder 5 is in engagement with the gripping cylinder 4. The peripheral velocity of the pair of feed rolls 2 is less than the peripheral velocity of the gripping cylinder 4 and the peripheral velocity of the mating cylinder 5 placed in engagement therewith so that the strip 6 is pulled and thereby torn along a line of perforations extending transverse to the direction of travel of the web 1.

A leading end 6A of the strip 6 is held fast on the gripping cylinder 4 by grippers 22A located within grooves 22 which extend parallel to an axis 4A of the gripping cylinder 4. The strip 6 as conveyed on the gripping cylinder 4 by the grippers 22A within groove 22 is then furnished with a stripe of adhesive by means of an adhesive application roll 7A of an adhesive application station 7. Adhesive application roll 7A obtains adhesive by contact of adhesive applicator 7B with adhesive supply roll 7C rotating in adhesive supply trough 7D filled with adhesive 7E.

There is a further, second gripping cylinder 8 for cooperation with the gripping cylinder 4 and which acting together with a nip cylinder 9 tears off individual strips 11 from a paper web 10, which is perforated at perforating station 13 as is done at perforating station 3. The web 10 is drawn off in the same manner by a pair of rolls 12 from a supply roll, not illustrated, as is done for paper web 1. Lines of perforations are produced in the web 10 at perforating station 13 with a spacing therebetween.

Before the individual strips 11 are torn off from the web 10, the web 10, as moved over a bend cylinder 14, passes adjacent to a roller 15A of a gripping, folding and application device 15, which forms angled U-shaped handles 17 in a known manner from the gripping strips 16 supplied to it. Each U-shaped handle 17 includes two limbs 17A interconnected by a crosspiece 17B.

As regards the manner of production of the U-shaped angled handles 17, attention is called to the German patent publications 2,012,084 C, 1,152,602 C, 1,181,035 C and 2,018,081 C.

The U-shaped angled handles 17 are applied with a spacing between them on the web 10 so that each torn off strip 11 is furnished with an angled handle 17. The limbs 17A of the angled handles are bonded in place at the bend roll 14 on the web 10 by a layer of a hotmelt adhesive 18A. The hotmelt adhesive unit is indicated generally by an arrow 18 indicative of a direction of application of adhesive.

Figure 2:
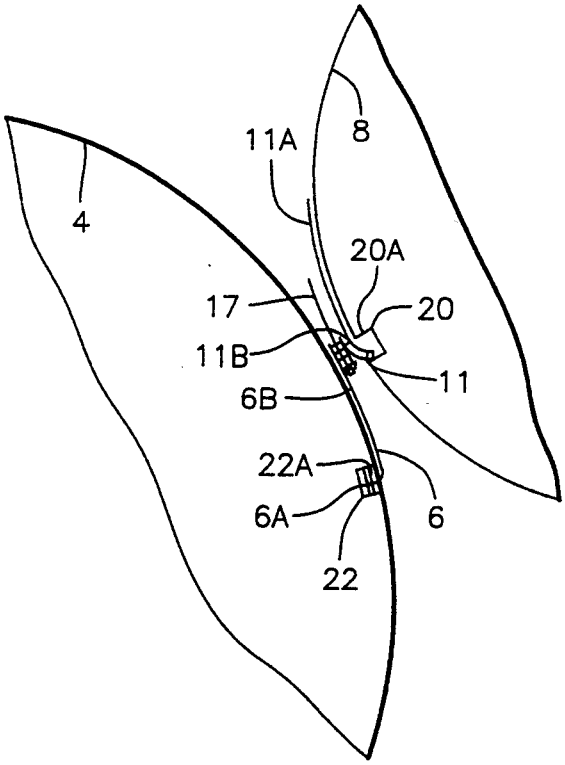
FIG. 2 shows the encircled part of the apparatus shown in FIG. 1 on an enlarged scale.

The nip cylinder 9 is furnished with a blade-like rib 9A, which thrusts the strip 11 with the angled handle 17 bonded thereto into the holding tongs or gripper 20A arranged in a groove 20 of cylinder 8 so that the strip 11 is folded as shown in FIG. 2. Following the gap between the cylinders 8 and 9 there is a sheet metal element, which folds over a part 11A of strip 11 which is not bonded to the limbs of the handle, onto part 11B of the strip 11 which is bonded to the limbs of the carrying handles, in the manner indicated in FIGS. 1 and 2 so that the parts 11A and 11B folded together are held fast by the tongs or gripper 20A.

Figure 3:
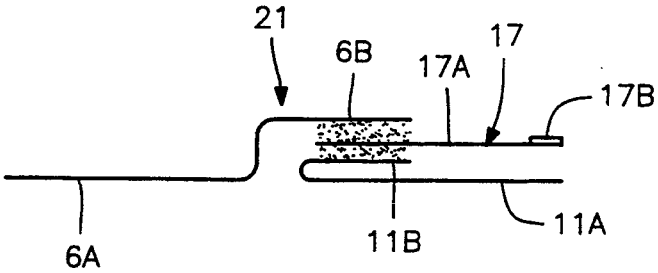
FIG. 3 shows a carrying handle assembly consisting of a U-shaped handle part bonded to two material strips.
Figure 4:
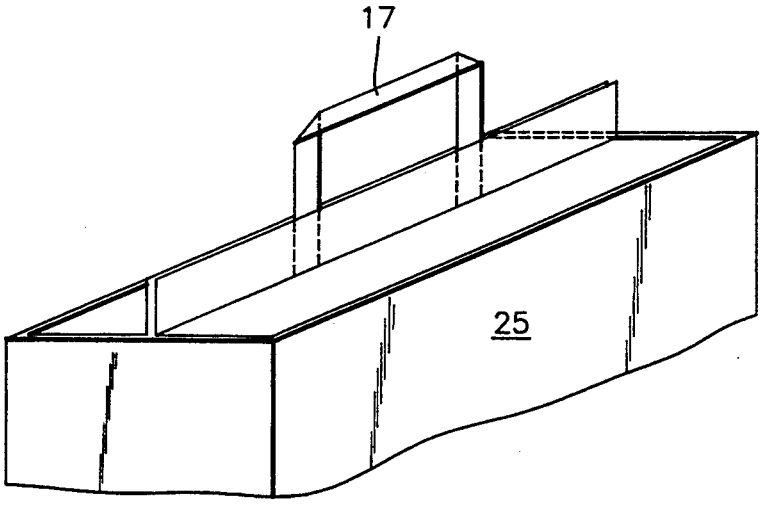
FIG. 4 shows a perspective view of the carrying handle assembly bonded to a flat, rectangular bottom of a bag.

The part marked in a dotted circle in FIG. 1 is illustrated on an enlarged scale in FIG. 2. It will be seen from this figure that the strip 6, which is supplied by the gripping cylinder 4 and has adhesive applied to its end 6B, is stuck to the limbs 17A of the angled handle 17 and to the leading edge 11B of the strip 11. The gripping cylinder 8 then opens its grippers 20A so that the prepared carrying handle assembly 21 (see FIG. 3) is only conveyed by the tongs 22A of the gripping cylinder 4.

During the further course of the movement of the gripping cylinder 4 the handle assembly 21 is then moved past an adhesive application means 19, by means of which the entire surface 6A of the strip 6 and surface 11A the strip 11 turned towards the adhesive application unit 19 are covered with adhesive 19A. Following this the carrying handle assembly 21 is bonded to the bottom 23 of a bag 25 being conveyed over the cylinder 24. At its end 23A remote from the carrying handle assembly 21, the bag 25 is still open with the result that following bonding of the carrying handle assembly 21 to the bag 25, the bag 25 may, for instance, be filled with diapers, after which the filling end 23A of the bag 25 will then be closed. Having described the invention, many modifications thereto will become apparent to those skilled in the art to which it pertains without deviation from the spirit of the invention as defined by the scope of the appended claims.

I claim:

1. A carrying assembly comprising:

a bag having a flat bottom, two strips of material bent into an L-shape cross section, one portion of each of said two strips of material extending generally in a single plane and bonded to said flat bottom of said bag and confined within boundaries of said flat bottom of said bag, the other portions of each of said two strips of material being arranged along side of each other and bonded together, and a carrying handle bent into a U-shape having two limbs interconnected by a crosspiece, said two limbs being bonded between said other portions of said two strips of material.

2. The carrying assembly as claimed in claim 1, wherein said two strips of material and said carrying handle comprise paper.

3. The carrying assembly as claimed in claim 1, wherein a free end of each of said two limbs is secured between said other portions of said two strips of material.

* * * * *